US012114712B2

(12) United States Patent
Blecha et al.

(10) Patent No.: US 12,114,712 B2
(45) Date of Patent: Oct. 15, 2024

(54) SOCKS HAVING TARGETED CUSHIONING ZONES

(71) Applicant: Lululemon Athletica Canada Inc., Vancouver (CA)

(72) Inventors: Joseph Simon Blecha, Arch Cape, OR (US); Kenneth Todd Craig, Portland, OR (US); Brittany Autumn Woodward, Portland, OR (US); Christopher Ka-Yin Lam, Portland, OR (US)

(73) Assignee: Lululemon Athletica Canada Inc., Vancouver (CA)

( * ) Notice: Subject to any disclaimer, the term of this patent is extended or adjusted under 35 U.S.C. 154(b) by 51 days.

(21) Appl. No.: 17/513,709

(22) Filed: Oct. 28, 2021

(65) Prior Publication Data

US 2022/0125129 A1 Apr. 28, 2022

Related U.S. Application Data

(60) Provisional application No. 63/106,629, filed on Oct. 28, 2020.

(51) Int. Cl.
*A41B 11/02* (2006.01)

(52) U.S. Cl.
CPC ..... *A41B 11/02* (2013.01)

(58) Field of Classification Search
CPC . A41B 11/02; A41B 2400/20; A41B 2400/60; A41B 2500/10; A41B 11/00; A41B 11/001; A41B 11/005; D04B 1/02; D04B 1/104; D04B 1/26
USPC ..... 2/239, 240, 241; 66/185, 178 R
See application file for complete search history.

(56) References Cited

U.S. PATENT DOCUMENTS 1,553,811 A * 9/1925 Gilbert ..... A41B 11/02 2/241
2,384,079 A * 9/1945 Davis ..... D05B 23/009 2/241
3,793,851 A * 2/1974 Thorneburg ..... D04B 1/26 66/185
4,057,981 A * 11/1977 Runac ..... D04B 1/26 66/185
4,104,892 A * 8/1978 Thorneburg ..... A41B 11/02 66/178 R
4,277,959 A * 7/1981 Thorneburg ..... D04B 1/02 66/185
4,732,015 A * 3/1988 Abrams ..... D04B 15/61 66/185
5,708,984 A * 1/1998 Shofner ..... A41B 11/001 2/239
5,724,836 A * 3/1998 Green ..... D04B 1/02 66/185

(Continued)

*Primary Examiner* — Jameson D Collier
*Assistant Examiner* — Matthew R Marchewka
(74) *Attorney, Agent, or Firm* — Kolitch Romano Dascenzo Gates LLC

(57) ABSTRACT

Socks including targeted cushioning zones include various knitted materials disposed within areas of the foot which experience specific conditions during running. Areas of the sock which include cushioning pods correspond to areas of the foot which experience pressure loading. Areas of the sock which include mesh correspond to areas of the foot which produce sweat. Areas of the sock which include ribbing and/or cushioning pods correspond to areas of the foot which have sensitive skin.

18 Claims, 20 Drawing Sheets

(56) References Cited

U.S. PATENT DOCUMENTS

| | | | | |
|---|---|---|---|---|
| 2007/0094892 | A1* | 5/2007 | Craig | A41B 11/02 36/10 |
| 2008/0041113 | A1* | 2/2008 | Mori | D04B 1/26 66/171 |
| 2013/0172926 | A1* | 7/2013 | Barker | A61F 13/00 606/201 |
| 2015/0047103 | A1* | 2/2015 | Dahlgren | A41B 11/02 2/239 |
| 2016/0166419 | A1* | 6/2016 | Jones | A43B 7/1445 602/66 |
| 2017/0332703 | A1* | 11/2017 | Amis | D04B 1/26 |
| 2019/0029331 | A1* | 1/2019 | Field | A41B 11/003 |
| 2020/0399801 | A1* | 12/2020 | Ogden | D04B 1/02 |
| 2022/0117318 | A1* | 4/2022 | Polegato Moretti | A41B 11/00 |

* cited by examiner

SOCKS HAVING TARGETED CUSHIONING ZONES

CROSS-REFERENCES

The following applications and materials are incorporated herein, in their entireties, for all purposes: U.S. Provisional Patent Application Ser. No. 63/106,629, filed Oct. 28, 2020.

FIELD

This disclosure relates to systems and methods for cushioning stockings or socks. More specifically, the disclosed embodiments relate to cushioned performance socks.

INTRODUCTION

Running and other weight-bearing exercise activities apply pressure to certain areas of the foot. Reducing the impact of this pressure may increase comfort for a wearer, while also reducing incidence of injury, blistering, and/or other negative side effects of exercise.

SUMMARY

The present disclosure provides systems, apparatuses, and methods relating to socks having targeted cushioning zones.

In some examples, cushioned performance socks of the present disclosure include: a plurality of cushioning regions each including a plurality of raised cushioning pods disposed on an interior surface of the sock, wherein each of the raised cushioning pods comprises a plurality of terry loops; and a plurality of mesh regions; wherein the sock comprises a single seam disposed at a toe of the sock.

In some examples, cushioned performance socks of the present disclosure include: a cushioning region corresponding to a ball of a foot when worn, the cushioning region including a plurality of raised cushioning pods disposed on an interior surface of the sock, wherein each of the raised cushioning pods comprises a plurality of terry loops collectively capped by a plurality of looped strands of yarn; one or more mesh regions; and one or more ribbed regions; wherein the sock comprises a single seam disposed at a toe of the sock.

In some examples, cushioned performance socks of the present disclosure include: a cushioning region corresponding to a ball of a foot when worn, the cushioning region including a plurality of raised cushioning pods disposed on an interior surface of the sock, wherein each of the raised cushioning pods comprises a plurality of terry loops collectively capped by a plurality of looped strands of yarn; and one or more ribbed regions; wherein the sock comprises a single seam disposed at a toe of the sock.

Features, functions, and advantages may be achieved independently in various embodiments of the present disclosure, or may be combined in yet other embodiments, further details of which can be seen with reference to the following description and drawings.

DETAILED DESCRIPTION

Figure 1:
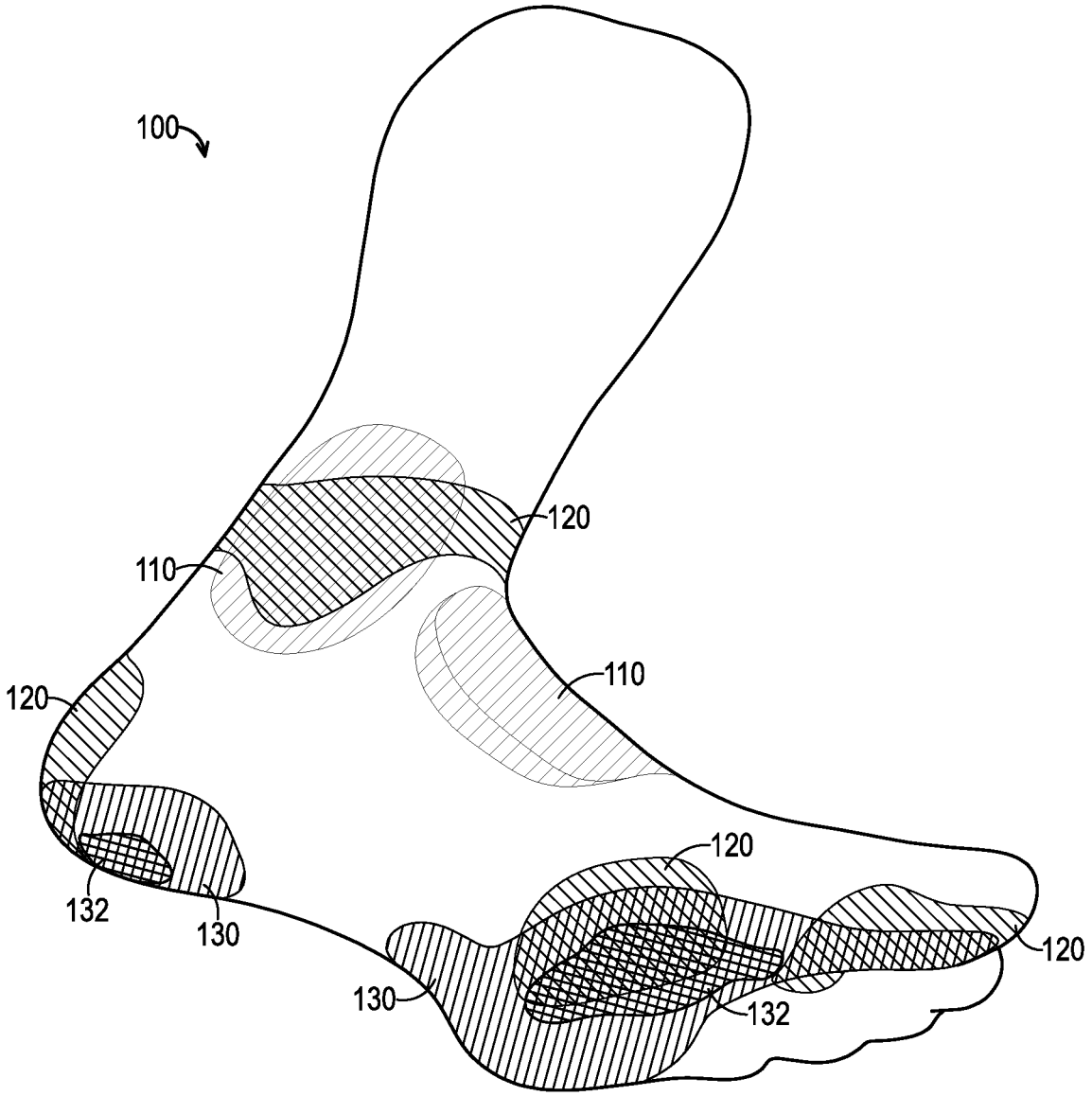
FIG. 1 is an isometric right-side view of an illustrative zone distribution in accordance with aspects of the present disclosure.

Various aspects and examples of socks having targeted cushioning zones, as well as related methods, are described below and illustrated in the associated drawings. Unless otherwise specified, a sock having targeted cushioning zones in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

The terms "medial," "lateral," "anterior," "posterior," and the like are intended to refer to anatomical directions corresponding to a human foot. For example, "medial" refers to a relative position disposed toward the center of the human body, while "lateral" refers to a relative position disposed away from the center of the human body. "Anterior" refers to a relative position closer to the toe of a wearer and "posterior" refers to a relative position closer to the heel of the wearer. In the absence of a wearer, the same directional terms may be used as if the article of footwear is being worn in its expected configuration.

The terms "top" and "bottom" are intended to refer to portions of the sock as it is worn by a human foot. "Top" or "dorsal" portions of the sock contact top portions of the foot when worn, and "bottom" or "plantar" portions of the sock contact the sole of the foot when worn.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

"Coupled" means connected, either permanently or releasably, whether directly or indirectly through intervening components.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

A "sock" or "stocking" is an article of apparel that covers portions of the foot and, in some examples, the lower leg. Socks may or may not have toe and/or heel portions, and may cover only some (or none) of the toes.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a sock or stocking in accordance with the present teachings includes a plurality of cushioning zones disposed beneath areas of the foot expected to experience high levels of impact while a wearer is running or performing high-impact exercise. The cushioning zones each include a plurality of cushioning pillows (AKA cushioning pods) disposed on an interior surface of the sock. The cushioning pillows are arranged in zones or areas having various densities and/or density gradients, depending on a desired level of cushioning. The sock includes a higher density of cushioning pillows (e.g., a higher number per square cm) in areas of the sock which may experience higher pressure impact during activities, and includes a lower density of cushioning pillows in areas of the sock where less or lower pressure impact is expected during activities. In some examples, the sock includes a cushion gradient, wherein a pillow density gradually decreases from high cushion areas to low cushion areas.

Cushioning pillows may be distinguished by an increased thickness in the cushioning pillows when compared with the adjacent fabric. An increased fabric thickness within the cushioning pillows results from an increased stitch size, an increased needle size, the inclusion of terry loops, and/or the inclusion of upright yarn strands within the cushioning pillows. Terry loops included in the cushioning pillows may vary in loop density, loop length, loop height, and/or the like. In some examples, the cushioning pillows comprise a plurality of densely packed terry loops overlaid or capped by longer terry loops.

In some examples, a cushion gradient includes a plurality of pillows having a same shape and size, which are disposed closer together and in greater number in high cushion areas and farther apart and in lesser number in low cushion areas. In some examples, the cushion gradient includes a plurality of pillows having different shapes and/or sizes, which are disposed in a consistent numerical distribution throughout the cushioning zones, but which are generally larger in size in high cushion areas and smaller in size in low cushion areas. In some examples, the cushion gradient includes a plurality of pillows having different shapes and/or sizes, which are disposed closer together and in greater number in high cushion areas and farther apart and in lesser number in low cushion areas.

In some examples, the sock includes mesh areas disposed adjacent to areas of the foot which produce high amounts of sweat. The mesh provides increased breathability and sweat absorption. In some examples, the sock includes cushioned and/or ribbed areas disposed adjacent to areas of the foot which are sensitive to pressure, rubbing, and/or chafing.

Additionally and/or alternatively, areas of the sock disposed adjacent to sensitive areas of the foot which also bear weight may include cushioned regions (e.g., pillows and/or generally cushioned fabric). Areas of the sock disposed adjacent to sensitive areas of the foot which do not bear weight may include a ribbed fabric configured to reduce irritation, as ribbed fabric partially sets off the fabric from the skin, e.g., without the inclusion of a terry fabric.

In some examples, a method of manufacturing socks according to aspects of the present disclosure includes: determining a distribution of cushioning, sweat dissipation, and sensitive zones; and manufacturing a sock including pillows disposed in a number of cushioning zones, mesh disposed in sweat dissipation and/or absorption zones, and ribbed fabric disposed in sensitive zones.

Examples, Components, and Alternatives

The following sections describe selected aspects of illustrative socks or stockings having targeted cushioning zones as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Zone Distribution

Figure 2:
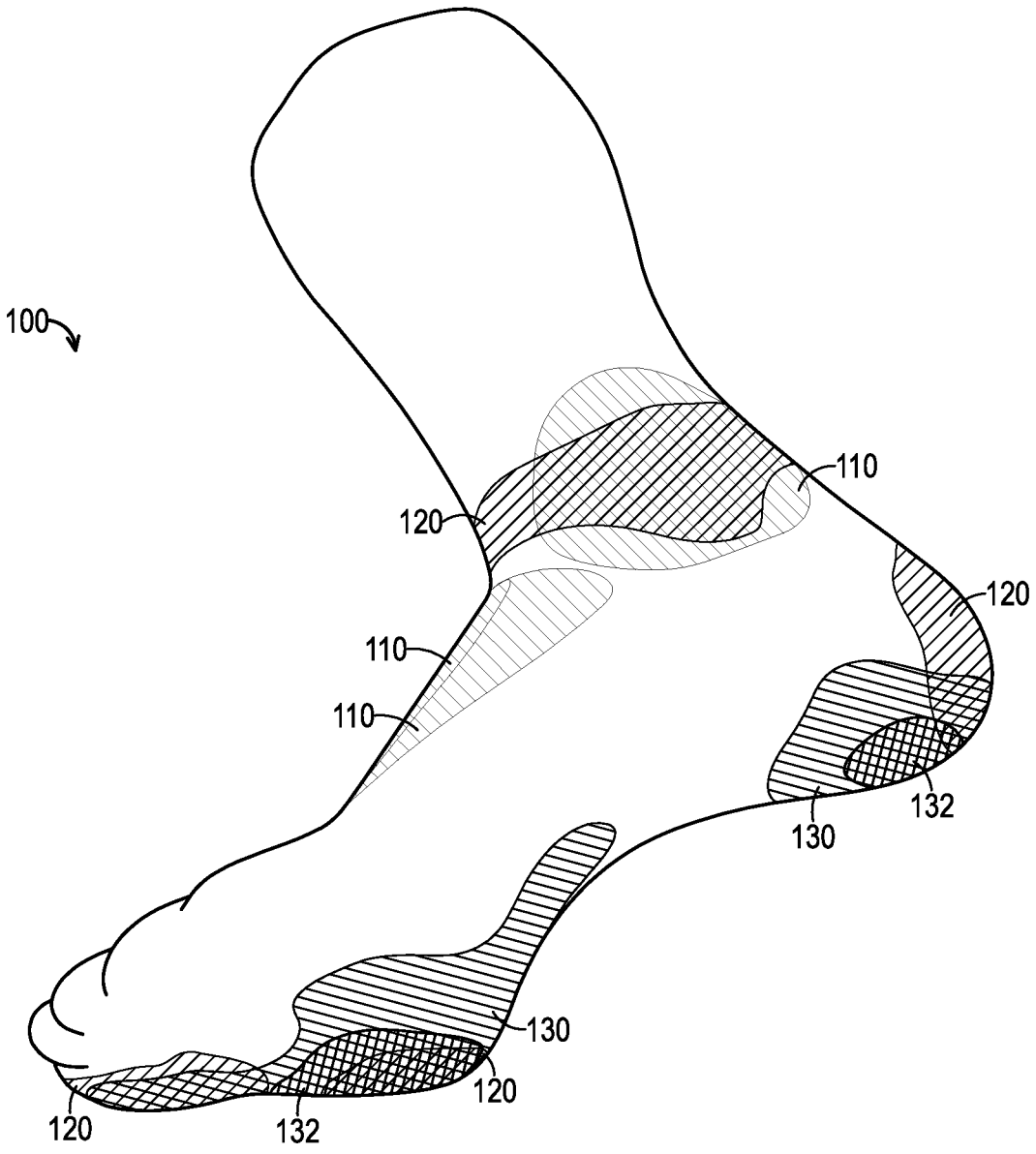
FIG. 2 is an isometric left-side view of the illustrative zone distribution of FIG. 1.

Cushioning socks of the present disclosure include specific knit patterns arranged into areas or zones of the sock based on expected conditions during running or other sport activities. This section describes an illustrative zone distribution pattern for socks. FIGS. 1 and 2 depict a computer model of a foot 100 including areas of sweat production 110, areas of skin sensitivity 120, and areas which experience high levels of impact during weight-bearing exercise (AKA pressure loading) 130, 132.

The computer model depicted in FIGS. 1 and 2 was developed from a composite of pressure-mapping and skin sensitivity-mapping data obtained from running test subjects. In some examples, socks and/or stockings according to the present disclosure include cushioning patterns developed from pressure-mapping and skin sensitivity-mapping data obtained from test subjects performing a variety of athletic activities (e.g., tennis, walking, basketball, etc.).

Computer foot model 100 is utilized to determine knit patterns (e.g., cushioning, mesh, ribbing structures, etc.) disposed in specific areas within the socks described below. Zones of pressure loading 130, 132 correspond to areas including cushioning pods or pillows. Zones of pressure loading 130 and 132 may denote different degrees of pressure loading, such that zone 130 denotes a zone expected to experience a comparatively low degree of pressure loading, and zone 132 denotes a zone expected to experience a comparatively high degree of pressure loading. Accordingly, a cushioning gradient within socks described below may include comparatively high levels of cushioning within zones of pressure loading 132 and comparatively low levels of cushioning within zones of pressure loading 130. Zones of sweat production 110 correspond to areas including mesh (AKA mesh windows). Zones of skin sensitivity 120 may correspond to areas including pillows and/or ribbing structures, depending on a location of the zone relative to the foot and to adjacent zones of pressure loading and sweat production. Areas of skin sensitivity disposed beneath the heel, toes, and other portions of the foot may include pillows, which provide a maximum level of protection from rubbing and/or chafing. In some examples, areas of skin sensitivity disposed near the ankle include smooth ribbed sections, as these areas are not subject to a "pressure load" exerted by body weight, and ribbed fabric reduces bulk within the sock fabric. In some examples, areas of skin sensitivity disposed near the ankle include pillows and/or other forms of cushioning. Areas of skin sensitivity generally do not include mesh fabric, as mesh does not protect the foot from either loading or abrasion. Accordingly, mesh zones are generally not disposed in weight-bearing areas of the foot.

Zones included within computer model 100 may correspond to specific areas of the foot. Zones of sweat production 110 may be disposed at the dorsum of the foot, and at the medial and lateral malleolus of the ankle. Zones of skin sensitivity 120 may be disposed around the circumference of the ankle, at the back of the heel, at the medial toe joints, and at the bottom of the hallux (AKA big toe). Zones of pressure loading 130, 132 may be disposed at the ball of the foot and the bottom of the heel. Socks described and depicted in the following sections may include knitting patterns arranged according to the zones identified in computer model 100. In some examples, alternative computer models are utilized to determine zones and knitting pattern distributions. In some examples, computer models are derived from test subjects performing a variety of athletic activities, such as running, playing tennis, walking, playing basketball, and/or the like. In some examples, computer models are derived from test subjects performing a variety of athletic activities, with data averaged and/or aggregated to produce a computer model suitable for a general-purpose user. Socks manufactured according to manufacturing methods described in the following sections are manufactured according to knitting machine instructions generated according to the zones identified in a computer model, such as computer model 100.

B. First Illustrative Sock

Figure 3:
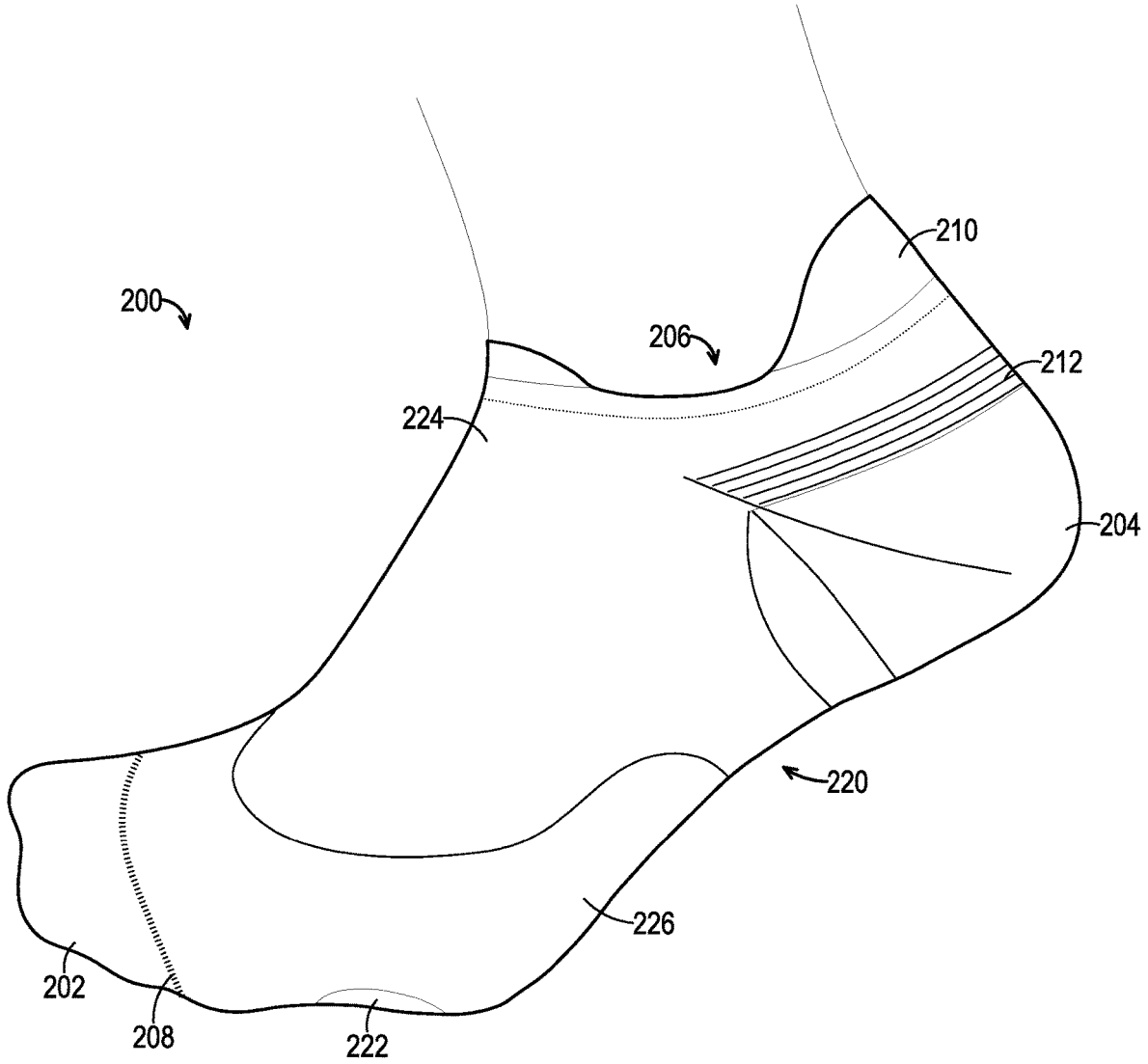
FIG. 3 is a schematic diagram of an illustrative sock including a plurality of cushioning zones in accordance with aspects of the present disclosure.

As shown in FIG. 3, this section describes a first illustrative sock 200 having targeted cushioning zones. FIG. 3 depicts a schematic view of sock 200 including a cushioning pattern arranged according to the zones described above. Although a computer model such as model 100 may be utilized to determine placement of different functional zones or regions, such placement may differ from that shown in FIG. 1, e.g., due to different expected use cases, etc. Sock 200 includes a toe portion 202 and a heel portion 204 separated by a sock body 220. Sock body 220 comprises a tube of knitted material. Sock 200 includes a foot opening 206 disposed at one end of the knitted tube and a toe seam 208 disposed at a top surface of a junction between the toes of a wearer and the remainder of the foot. In some examples, sock 200 includes a heel tab 210 configured to protect the heel of a wearer from rubbing against a shoe.

Toe portion 202 extends from tips (i.e., distal ends) of the toes of a wearer to the bases (i.e., proximal ends) of the toes. Heel portion 204 includes a cup configured to fit the heel of a wearer and extends from the base of a wearer's heel to the base of the wearer's ankle. Toe portion 202 and heel portion 204 each comprise a cushioned knitted material. In some examples, toe portion 202 and heel portion 204 comprise a terry material. In some examples, toe portion 202 and heel portion 204 comprise a ribbed material having an increased thickness when compared with a thickness of sock body 220. In some examples, sock 200 further includes elastic ribbing (e.g., high power elastic ribbing) 212 disposed between heel portion 204 and heel tab 210, which retains the wearer's heel within the heel portion 204. Elastic ribbing 212 has a higher pull back strength than elastic used in other portions of the sock.

Sock body 220 comprises a plurality of knitted zones or regions comprising different knitted fabrics). In some examples, sock body 220 is formed as a single piece, and knitted fabric zones are formed within the sock body using a computerized knitting machine. In some examples, sock body 220 comprises multiple pieces of woven and/or knitted material which are sewn, joined, or otherwise coupled together. Sock body 220 includes cushioning zones 222 having a plurality of cushioning pods or pillows, which are distributed based on an expected pressure loading within the zone. Sock body 220 further includes mesh zones 224, which comprise a knitted mesh configured to increase breathability within regions of the foot which produce sweat. Sock body 220 further includes ribbed zones 226, which correspond to regions of the foot which have high skin sensitivity. In some examples, regions of the foot which have high skin sensitivity include cushioning pods or pillows configured to protect the foot from rubbing or chafing.

C. Second Illustrative Sock

As shown in FIGS. 4-11, this section describes a second illustrative sock 300 having targeted cushioning zones. Sock 300 is an example of socks including knitting patterns arranged according to a computing model similar to that of FIG. 1. Although a computer model such as model 100 may be utilized to determine placement of different functional zones or regions, such placement may differ from that shown in FIG. 1, e.g., due to different expected use cases, etc. Sock 300 is similar to sock 200, except as described below.

Sock 300 includes a toe portion 302 and a heel portion 304 separated by a sock body 320. Sock body 320 comprises a tube of knitted material, which may be formed as a single piece. Sock 300 includes a foot opening 306 disposed at one end of the knitted tube and a toe seam 308 disposed at a top surface of a junction between the toes of a wearer and the remainder of the foot. In some examples, sock 300 includes a heel tab 310 configured to protect the heel of a wearer from rubbing against a shoe.

Sock body 320 includes cushioning zones 322 each having a plurality of cushioning pods or pillows 330, which are distributed based on an expected pressure loading within the zones. In some examples, cushioning zones 322 correspond to zones of pressure loading 130, as described above with respect to computer foot model 100. Accordingly, in some examples, the cushioning zones are disposed in areas of the sock corresponding to the ball of a wearer's foot. Sock body 320 further includes mesh zones 324, which comprise a knitted mesh configured to increase breathability in sweat-producing regions of the foot. In some examples, mesh zones 324 correspond to zones of sweat production 110, as described above with respect to computer foot model 100. Accordingly, in some examples, the mesh zones are disposed in areas of the sock corresponding to the dorsum of the foot and to the bottom of the arch of the foot. Sock body 320 further includes ribbed zones 326, which correspond to regions of the foot which have high skin sensitivity. In some examples, ribbed zones 326 correspond to zones of skin sensitivity 120, as described above with respect to computer foot model 100. Accordingly, in some examples, the ribbed zones are disposed in areas of the sock corresponding to the base of the toes and the bottom of the arch of the foot. In some examples, regions of the foot which have high skin sensitivity include cushioning pods or pillows, which protect the foot from rubbing or chafing. In some examples, regions of the foot which have high skin sensitivity include a dense terry material, which may cushion the foot.

Figure 4:
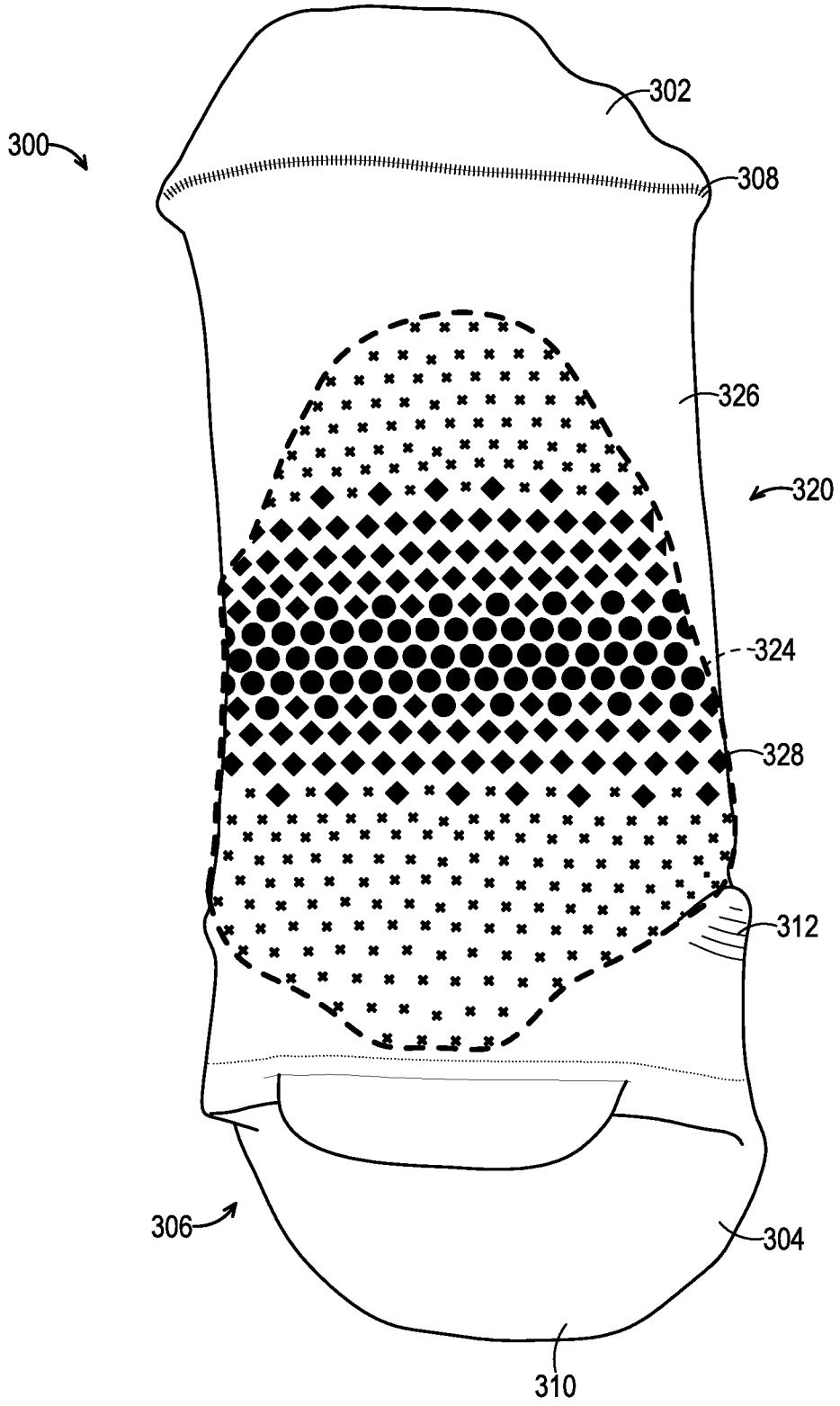
FIG. 4 is a top outside view of a first illustrative sock including cushioning zones in accordance with aspects of the present disclosure.
Figure 5:
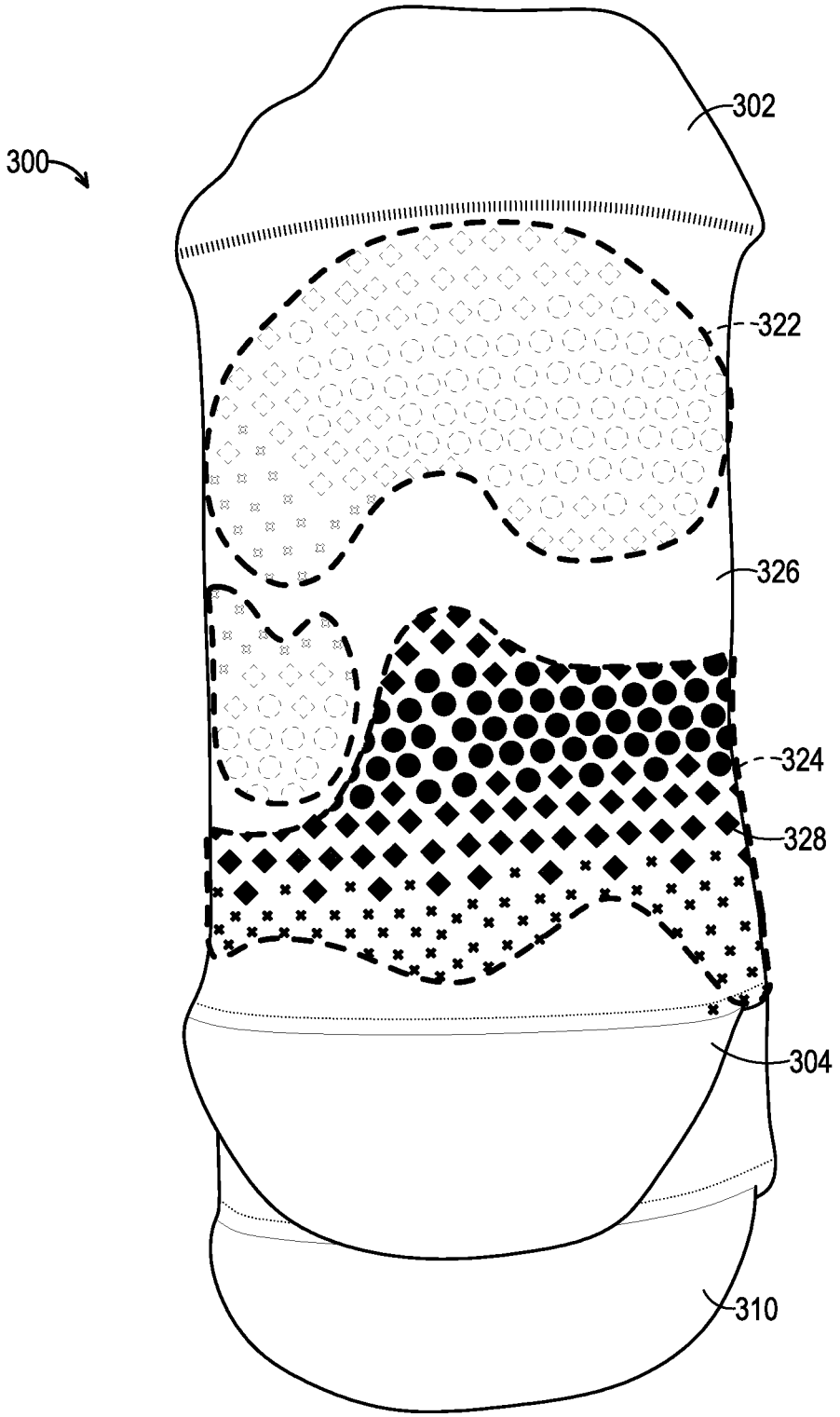
FIG. 5 is a bottom outside view of the sock of FIG. 4.

FIGS. 4 and 5 depict an outside surface of sock 300. Cushioning pods 330 are visible from the outside of the sock. However, the knit fabric on the outside of the sock has a flat finish. The flat finish of the outside of the sock is more durable than fabric including terry loops, as flat knitted material is less likely to catch or snag on rough surfaces than terry loops. Terry loops 332 of sock 300 are internal to the sock. The flat finish of the outside of the cushioning pods and the terry loops of the inside of the cushioning pods are formed of the same knit structure.

Figure 6:
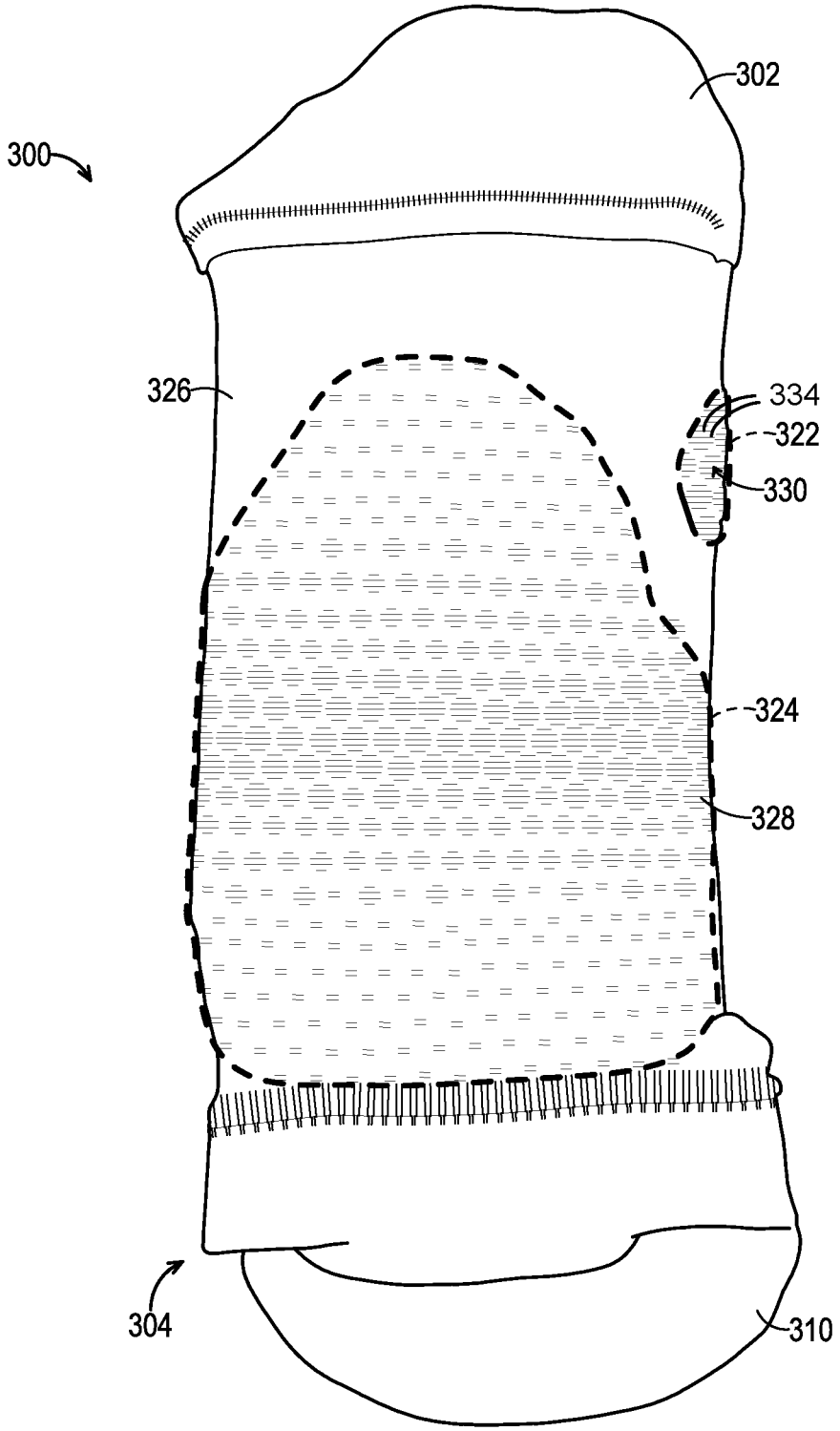
FIG. 6 is a top inside view of the sock of FIG. 4.
Figure 7:
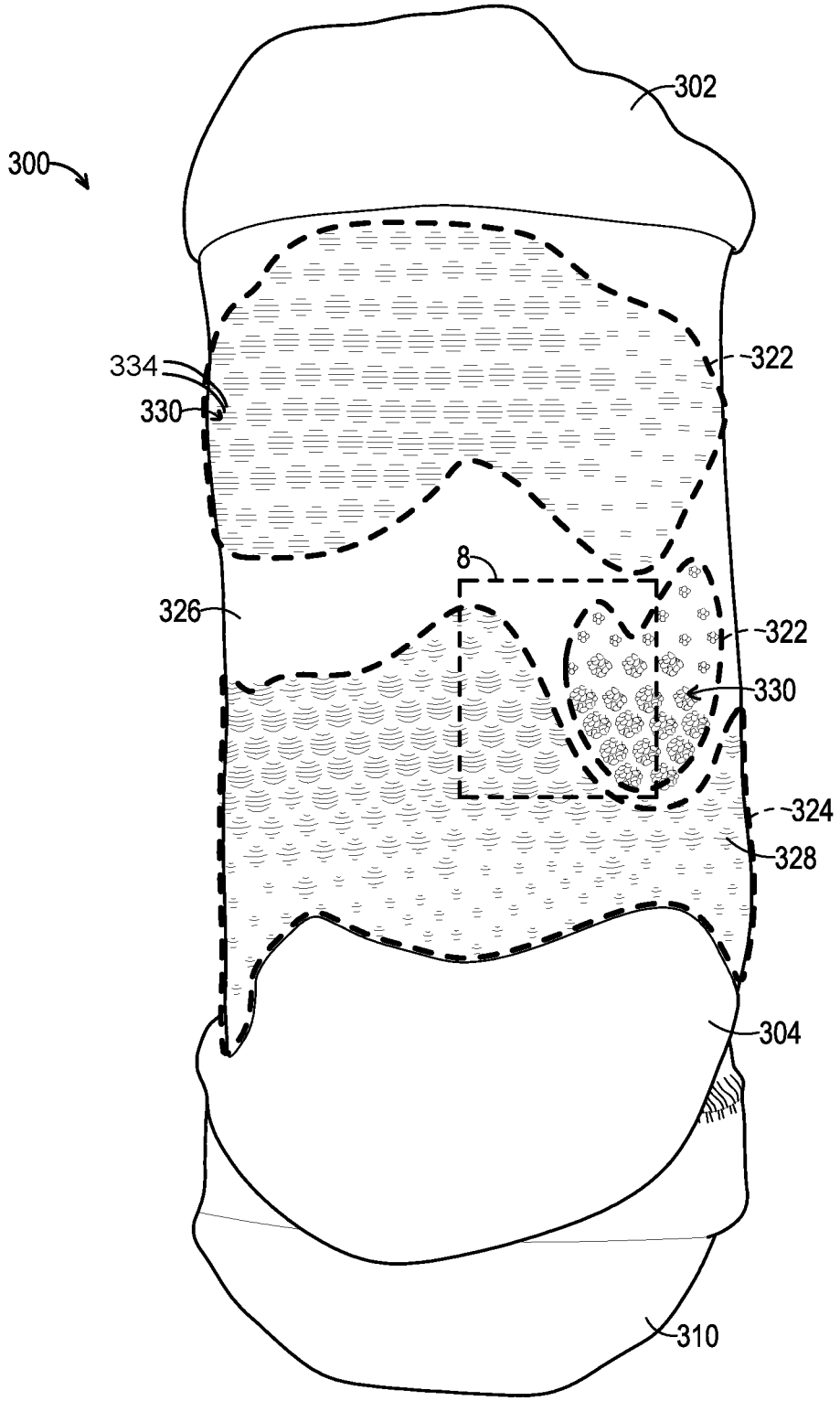
FIG. 7 is a bottom inside view of the sock of FIG. 4.
Figure 8:
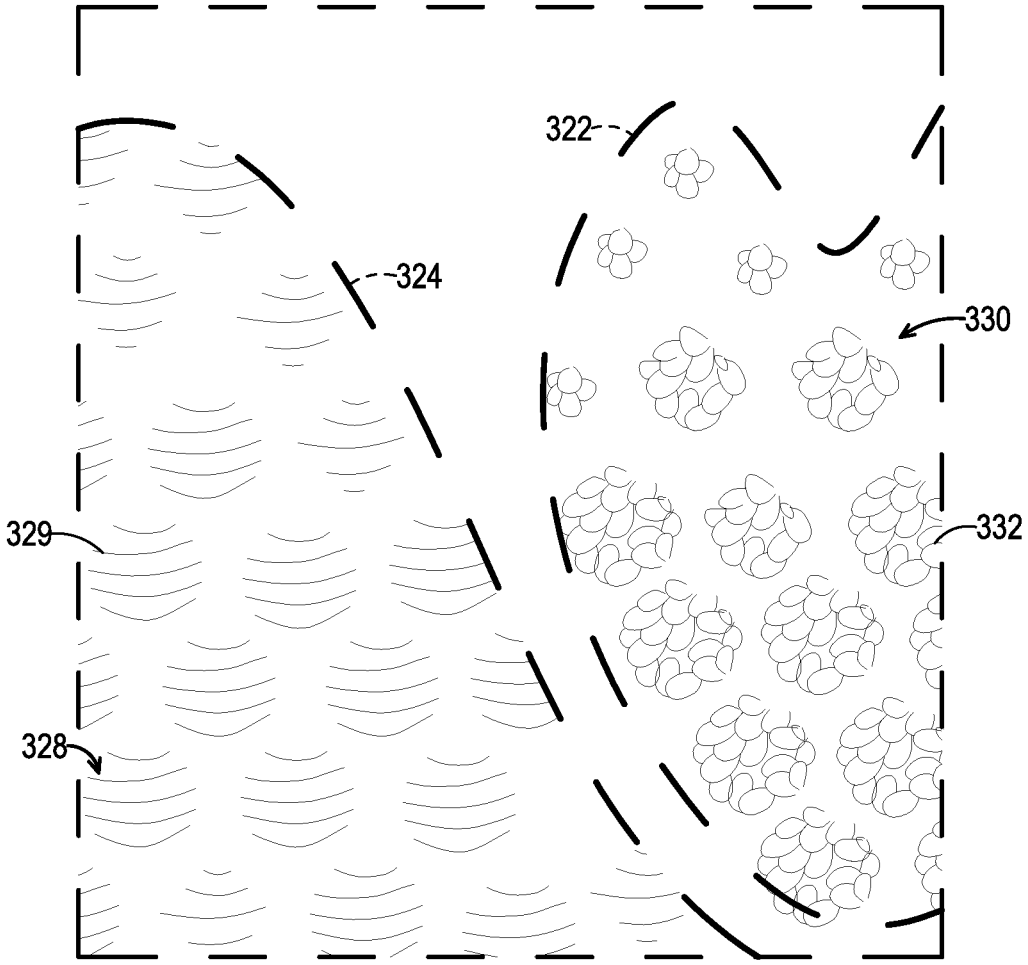
FIG. 8 is an enlarged view of a portion of the bottom inside view of FIG. 7

FIGS. 6, 7, and 8 depict an inside surface of sock 300. As best seen in FIG. 6, an internal surface of the top of sock 300 includes cushioning zones 322, mesh zones 324 and ribbed zones 326. Cushioning zones 322 disposed on the top of the sock Mesh zones 324 are disposed mainly on top portions of the sock disposed adjacent to foot opening 306. Mesh zones 324 are configured to improve breathability and sweat evaporation in sweat-producing regions of the foot. In some examples, mesh zones 324 include mesh windows (AKA mesh pods) 328 which are configured to provide lightweight cushioning in regions of the foot that are both sensitive and sweat-producing. Mesh windows 328 are visible on outside surfaces of the sock (see FIGS. 6 and 7), and comprise a "floating" mesh fabric formed within the knit structure of the sock. In some examples, the floating mesh fabric is offset from a wearer's foot by long yarn loops 329 extending a width of the mesh windows. Mesh windows 328 may have any suitable shape or size suitable for improving breathability in sweat-producing regions of a wearer's foot. Mesh windows 328 may be round, square, oval, oblong, rectangular, amorphous, triangular, and/or the like. Ribbed zones 326 are disposed adjacent toe portion 302. Ribbed zones 326 are configured to be lightweight and non-irritating to the skin of the foot.

FIG. 7 depicts an internal surface of the bottom of the sock. The internal surface includes cushioning zones 322, mesh zones 324, and ribbed zones 326. Cushioning zones 322 comprise a plurality of cushioning pods 330. The cushioning pods include pillows, each comprising a plurality of raised terry loops 332 formed within the knit structure of the sock. Terry loops on the inside of the sock absorb moisture and improve comfort for a wearer. Terry loops included in the cushioning pillows may vary in loop density, loop length, loop height, and/or the like.

FIG. 8 depicts an enlarged view of a portion of the bottom of the sock of FIG. 7. Cushioning zone 322 includes pods 330 comprising dense terry loops 332, which are closely packed. In contrast, mesh zone 324 includes mesh windows 328, which are backed by long loops 329, which extend a width of the mesh windows and offset the mesh fabric from the foot of a wearer. In some examples, the cushioning pods comprise a plurality of densely packed terry loops 332 overlaid by longer yarn loops 334 extending a width of the cushioning pod, which may produce a denser, firmer, cushioning pod (see the schematic sectional view of FIG. 9).

As depicted in FIGS. 6 and 7, a density of cushioning pods within any given cushioning zone varies depending on expected pressure loading at different areas within the cushioning zone. The cushioning pod density is gradated throughout the cushioning zones (e.g., varied in accordance with a gradient), such that a wearer experiences a gradual transition in sock cushioning within and/or between adjacent zones. For example, a cushioning zone disposed in areas of the sock corresponding to the ball of the foot of a wearer may have a relatively high density of cushioning pods in areas of the sock corresponding to a wearer's metatarsophalangeal joints, but may have a comparatively lower density of cushioning pods in areas of the sock corresponding to areas of the toes that experience less ground contact during exercise.

The degree of cushioning in the cushioning gradient is informed by computer model 100. Pressure loading data and skin sensitivity data included in computer model 100 is aggregated from a plurality of load maps generated during different moments of a test subject's stride. An amount of pressure loading in the heel, forefoot, and toe regions of the subject's foot varies based on weather the subject is "taking off" or "landing." The cushioning gradient in cushioning zone 322 is based on a combination of load maps generated during a variety of moments in the stride to provide optimal cushioning throughout the stride. In some examples, areas experiencing high levels of pressure (e.g., zones of pressure loading 130) or skin sensitivity (e.g., zones of skin sensitivity 120) have a high density of cushioning pods, while areas experiencing comparatively low levels of pressure or skin sensitivity have a lower density of cushioning pods. In some examples, areas experiencing high levels of pressure or skin sensitivity include larger cushioning pods, while areas experiencing comparatively low levels of pressure or skin sensitivity include smaller cushioning pods.

Cushioning pods 330 may have any shape or size suitable for reducing pressure loading on a wearer's foot. For example, cushioning pods 330 may be circular, square, oval, oblong, rectangular, amorphous, triangular, and/or the like. In some examples, cushioning pods are 1 mm in diameter or less. In some examples, cushioning pods may range in diameter from 0.5 mm to 10 cm.

Cushioning pillows are distinguished by an increased thickness in the cushioning pillows when compared with the adjacent fabric. An increased fabric thickness within the cushioning pillows may result from any suitable factor, such as an increased stitch size, an increased needle size, the inclusion of terry loops within the cushioning pillows, the inclusion of upright yarn strands within the cushioning pillows, and/or the like.

The internal surface of the bottom of sock 300 further includes a plurality of mesh pods 328 disposed in mesh zones 324. The mesh pods include a flat mesh material disposed, e.g., "floating," on the outside surface of the bottom of the sock, which improves breathability. In some examples, the "floating" mesh fabric is offset from a wearer's foot by long yarn loops extending a width of the mesh windows.

Figure 10:
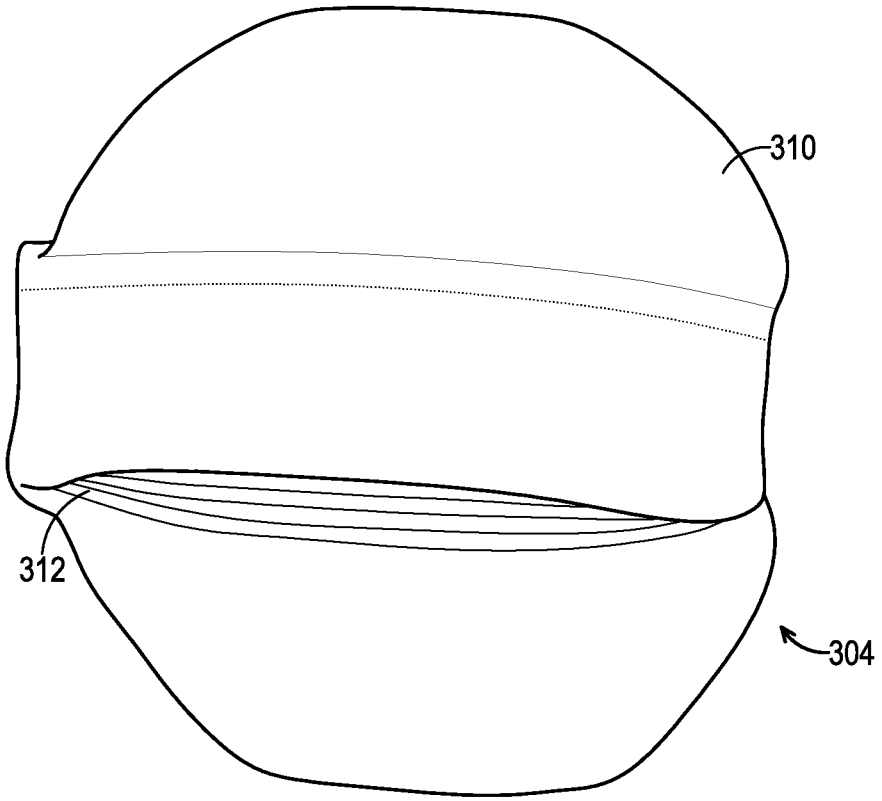
FIG. 10 is an outside view of a heel portion of the sock of FIG. 4.
Figure 11:
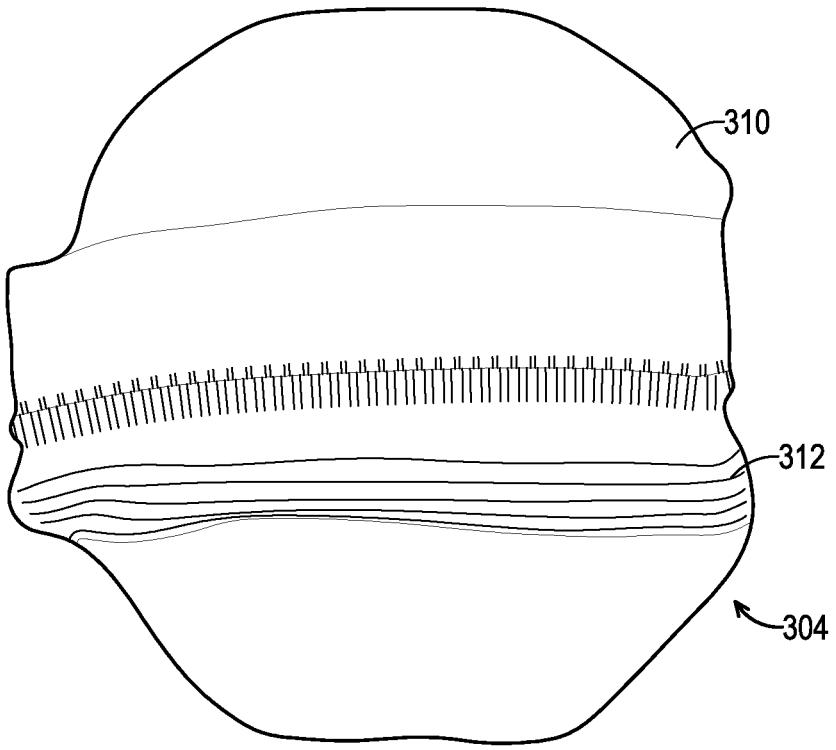
FIG. 11 is an inside view of a heel portion of the sock of FIG. 4.

FIGS. 10 and 11 depict heel portion 304 of sock 300. Heel portion 304 includes elastic ribbing (e.g., high power elastic ribbing) 312 disposed between heel portion 304 and heel tab 310, which retains the wearer's heel within the heel portion 304. Elastic ribbing 312 has a higher pull back strength than elastic used in other portions of the sock. When worn, elastic ribbing 312 may extend along the heel between a wearer's medial malleolus and lateral malleolus.

Sock 300 is knitted using yarns selected for their knitability, moisture management characteristics, durability, tactile experience, dye-ability, inherent stretch properties, and/or the like. In some examples, sock 300 is knitted using a filament nylon as body yarn, spandex as plating yarn, and double covered elastic throughout the sock body. In some examples, sock 300 includes yarns comprising polyester, cotton, wool, acrylic, polypropylene, high density polyethylene, and/or the like.

D. Third Illustrative Sock

FIGS. 12-17 depict a third illustrative sock 400 including targeted cushioning zones. Sock 400 is an examples of socks including knitting patterns arranged according to the computing model of FIG. 1. Although a computer model such as model 100 may be utilized to determine placement of different functional zones or regions, such placement may differ from that shown in FIG. 1, e.g., due to different expected use cases, etc. Sock 400 is similar to sock 200 and sock 300, except as described below.

Sock 400 includes a toe portion 402 and a heel portion 404 separated by a sock body 420. Sock body 420 comprises a tube of knitted material, which may be formed as a single piece. Sock 400 includes a foot opening 406 disposed at one end of the knitted tube and a toe seam 408 disposed at a top surface of a junction between the toes of a wearer and the remainder of the foot. In some examples, sock 400 includes a heel tab 410 configured to protect the heel of a wearer from rubbing against a shoe.

Sock body 420 includes cushioning zones 422, each having a plurality of cushioning pods or pillows, which are distributed based on expected pressure loading within the zone. In some examples, cushioning zones 422 correspond to zones of pressure loading 130, as described above with respect to computer foot model 100. Accordingly, the cushioning zones may be disposed in areas of the sock corresponding to the ball of a wearer's foot. Sock body 420 further includes mesh zones 424, which comprise a knitted mesh configured to increase breathability in regions of the foot that produce sweat. In some examples, mesh zones 424 correspond to zones of sweat production 110, as described above with respect to computer foot model 100. Accordingly, the mesh zones may be disposed in areas of the sock corresponding to the dorsum of the foot and to the bottom of the arch of the foot. Sock body 420 further includes ribbed zones 426, which correspond to regions of the foot that have high skin sensitivity. In some examples, ribbed zones 426 correspond to zones of skin sensitivity 120, as described above with respect to computer foot model 100. Accordingly, the ribbed zones may be disposed in areas of the sock corresponding to the base of the toes and the bottom of the arch of the foot. In some examples, regions of the foot that have high skin sensitivity include cushioning pods or pillows, which protect the foot from rubbing or chafing.

Figure 12:
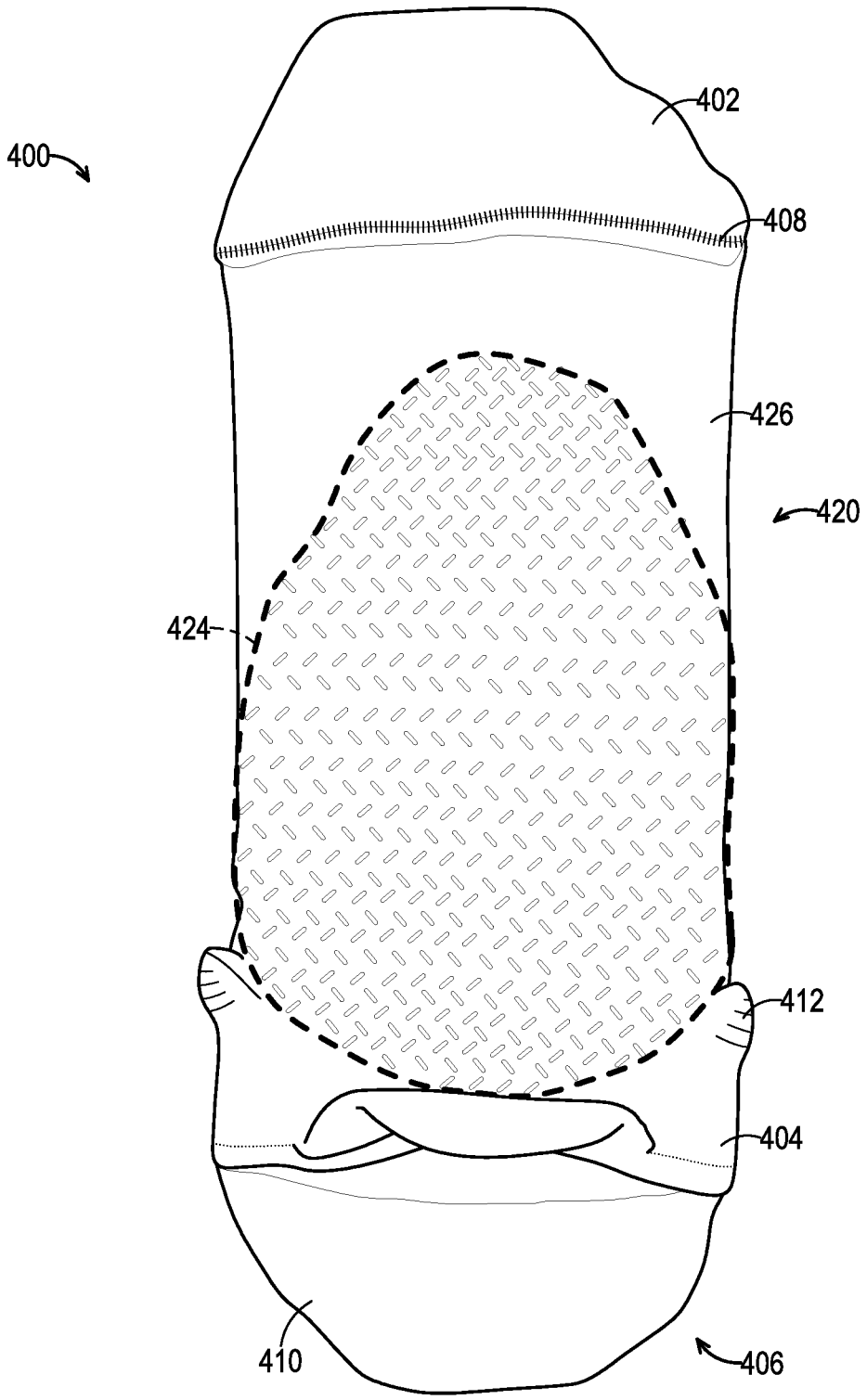
FIG. 12 is a top outside view of a second illustrative sock including cushioning zones in accordance with aspects of the present disclosure.
Figure 13:
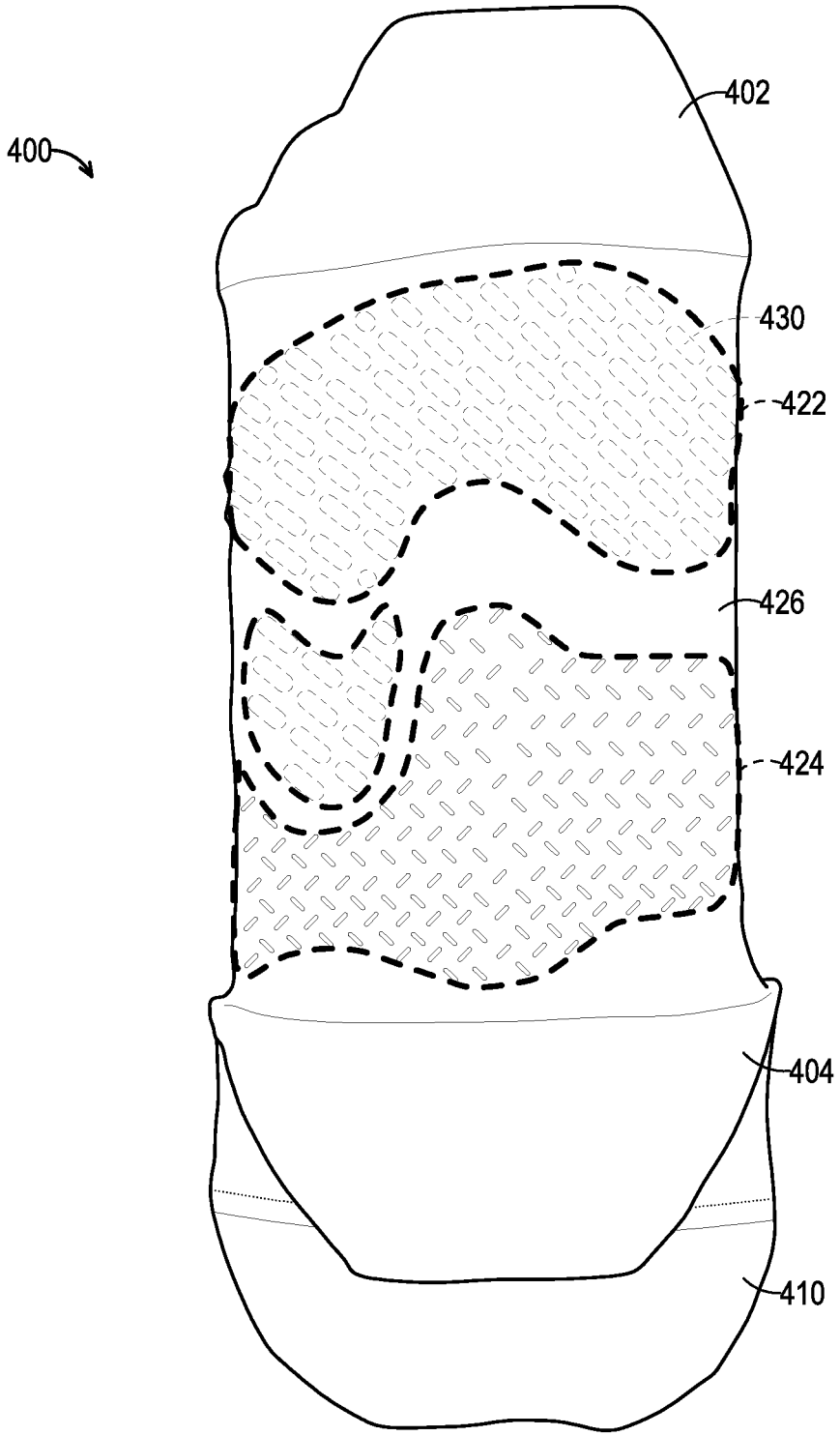
FIG. 13 is a bottom outside view of the sock of FIG. 12.

FIGS. 12 and 13 depict an outside surface of sock 400. As described above with respect to FIG. 5, the outside surface of sock 400 includes fabric having a flat finish, and terry loops of sock 400 are internal to the sock. Mesh zones 424 and ribbed zones 426 are visible on external surfaces of the top of sock 400, and are depicted in FIG. 12. Cushioned zones 422, mesh zones 424, and ribbed zones 426 are visible on external surfaces of the bottom of sock 400, and are depicted in FIG. 12.

Figure 14:
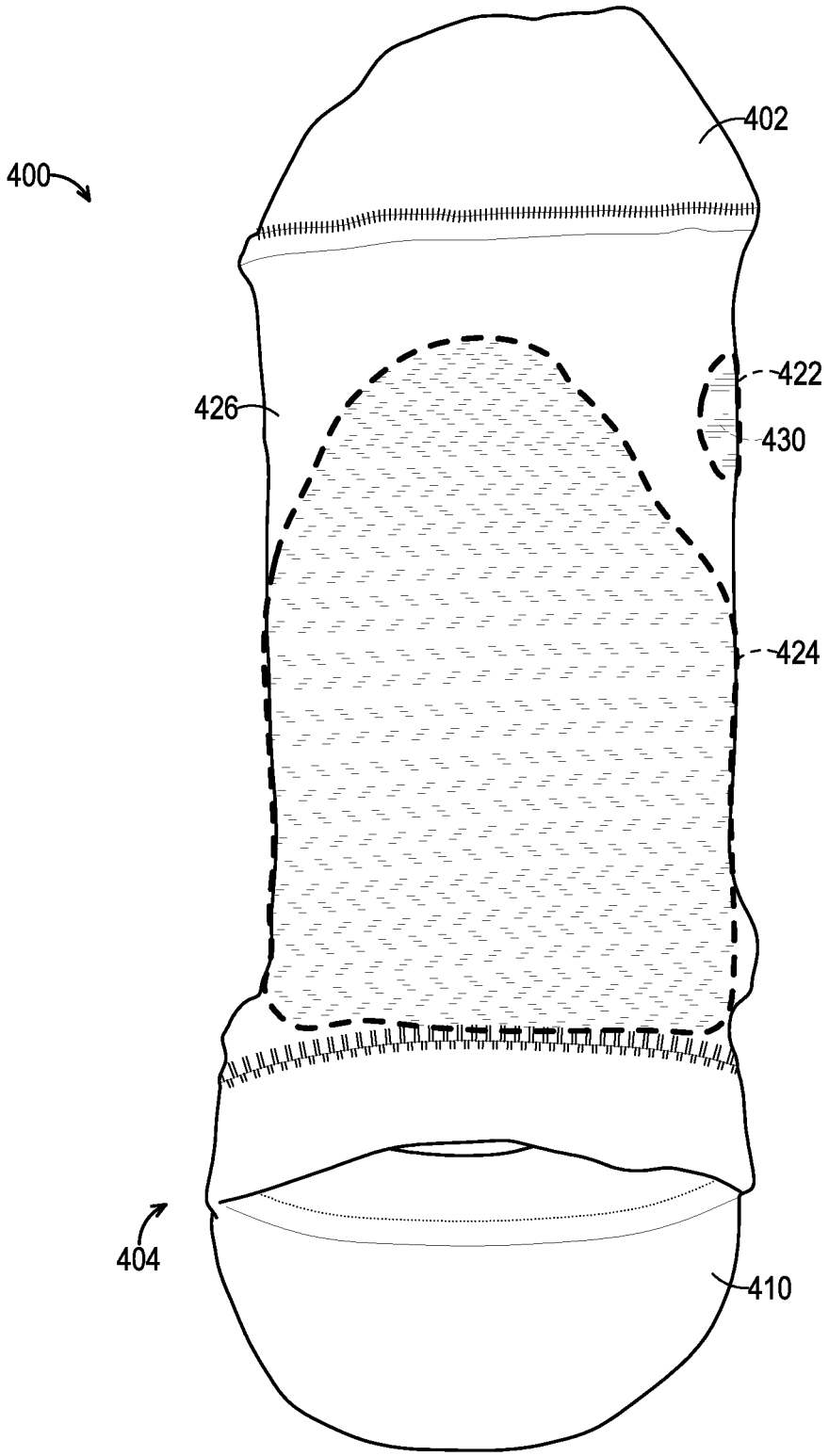
FIG. 14 is a top inside view of the sock of FIG. 12.
Figure 15:
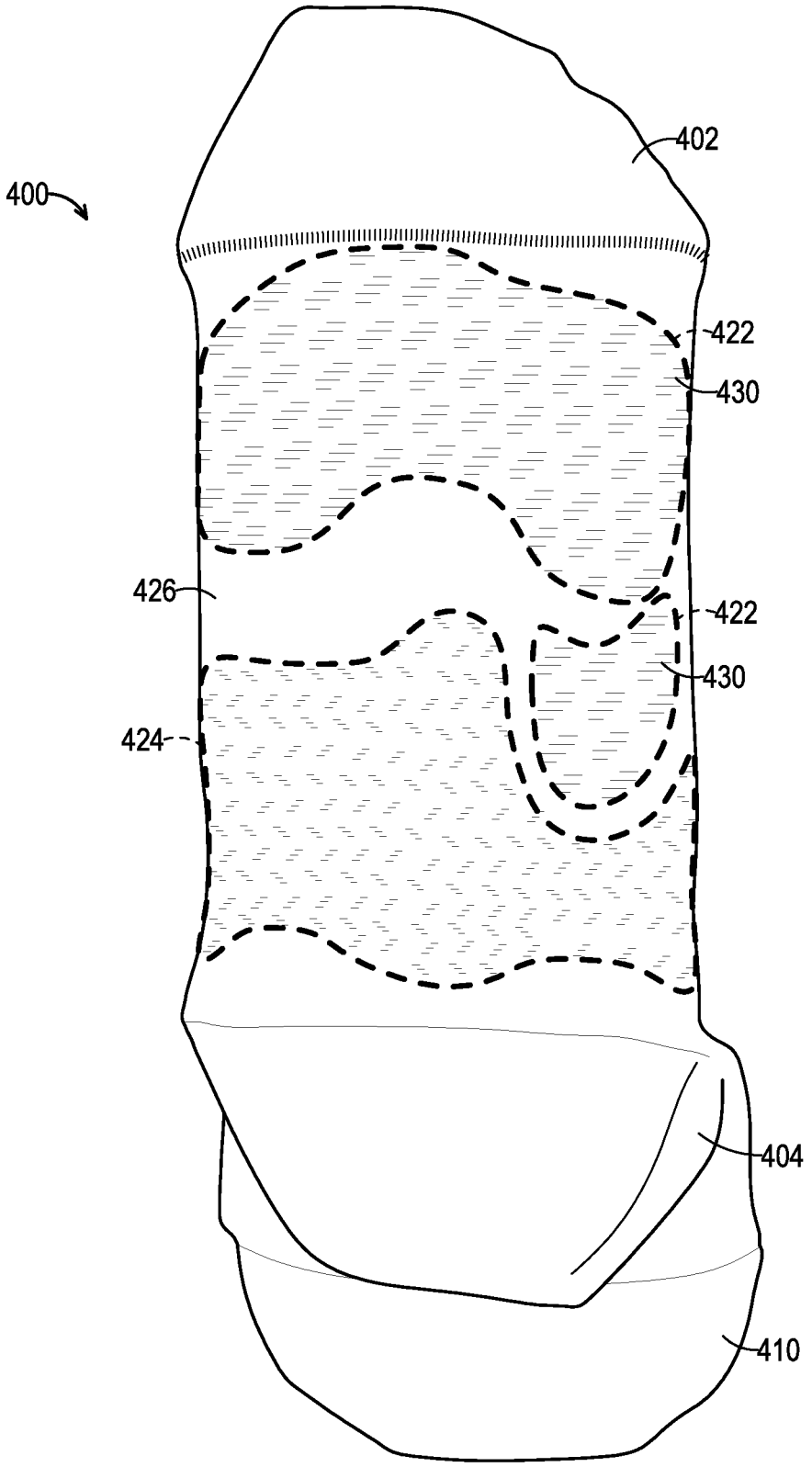
FIG. 15 is a bottom inside view of the sock of FIG. 12.

FIGS. 14 and 15 depict an inside of sock 400. As best seen in FIG. 14, an internal surface of the top of sock 400 includes mesh zones 424 and ribbed zones 426. Mesh zones 424 are disposed mainly on top portions of the sock disposed adjacent to foot opening 406. Mesh zones 424 are configured to improve breathability and sweat evaporation in sweat producing regions of the foot. Ribbed zones 426 are disposed adjacent to toe portion 402. Ribbed zones 426 are configured to be lightweight and non-irritating to the skin of the foot.

Figure 9:
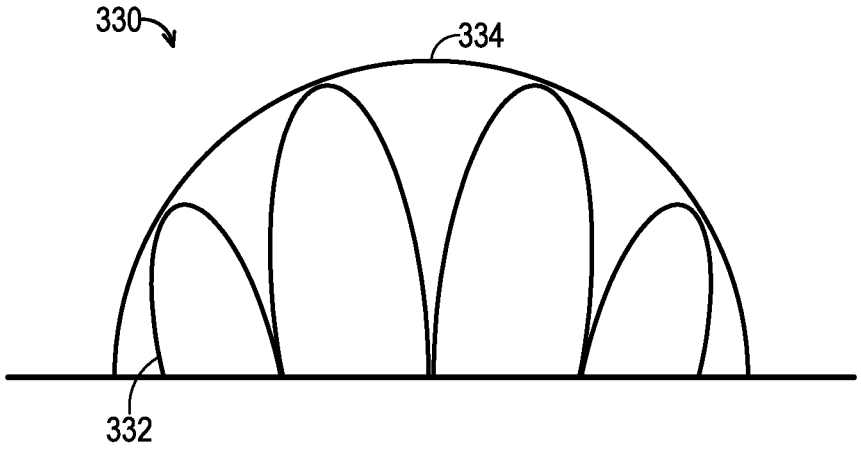
FIG. 9 is a schematic sectional view of an illustrative cushioning pillow suitable for inclusion in the sock of FIG. 4.

FIG. 15 depicts an internal surface of the bottom of sock 400. The internal surface includes cushioning zones 422, mesh zones 424, and ribbed zones 426. Cushioning zones 422 comprise a plurality of cushioning pods 430 disposed in the cushioning zone. The cushioning pods comprise substantially stadium-shaped pillows comprising a plurality of raised terry loops formed within the knit structure of the sock. In some examples, the plurality of raised terry loops is closely packed, as depicted in FIG. 8. In some examples, the cushioning pods comprise a plurality of densely packed terry loops overlaid by longer yarn loops extending a width of the cushioning pod, which may produce a denser, firmer, cushioning pod (as shown in FIG. 9).

Socks 300 and 400 include different degrees of cushioning arranged according to substantially similar patterns. Sock 300 is more cushioned than sock 400, and includes cushioning pods disposed in areas of the sock configured to be breathable. In contrast, sock 400 includes smaller cushioning pods arranged in a lower density than sock 300, and includes mesh portions which do not include cushioning pods (AKA cushioning pod-free mesh).

Figure 16:
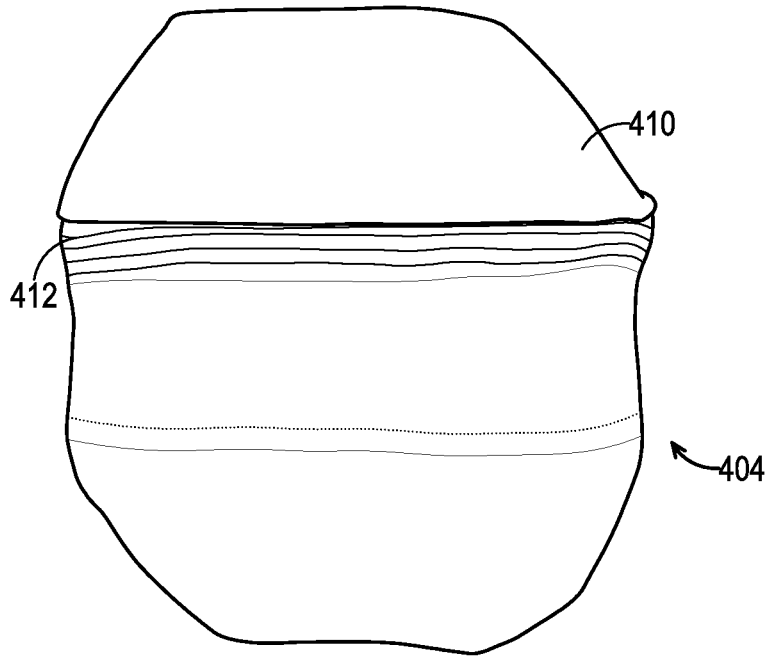
FIG. 16 is an outside view of a heel portion of the sock of FIG. 12.
Figure 17:
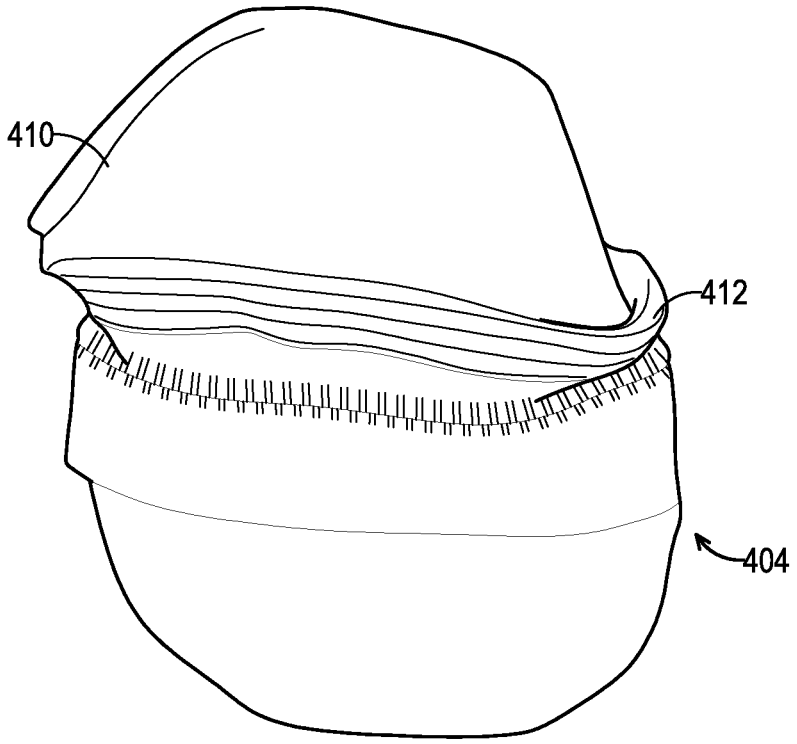
FIG. 17 is a bottom inside view of a heel portion of the sock of FIG. 12.

FIGS. 16 and 17 depict heel portion 404 of sock 400. Heel portion 404 includes elastic ribbing (e.g., high power elastic ribbing) 412 disposed between heel portion 404 and heel tab 410, which retains the wearer's heel within the heel portion 404. Elastic ribbing 412 has a higher pull-back strength than elastic used in other portions of the sock. When worn, elastic ribbing 412 may extend along the heel between a wearer's medial malleolus and lateral malleolus.

Figure 18:
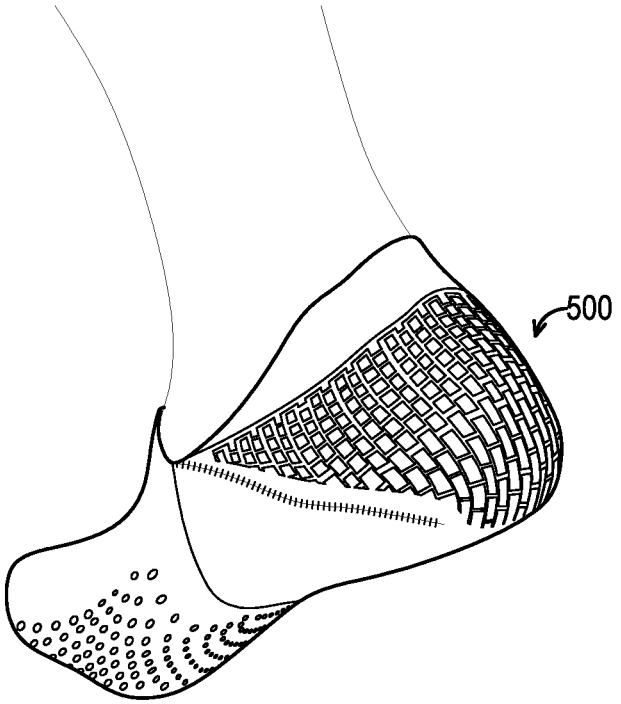
FIG. 18 is an outside view of a first illustrative heel knit pattern for socks described herein.
Figure 19:
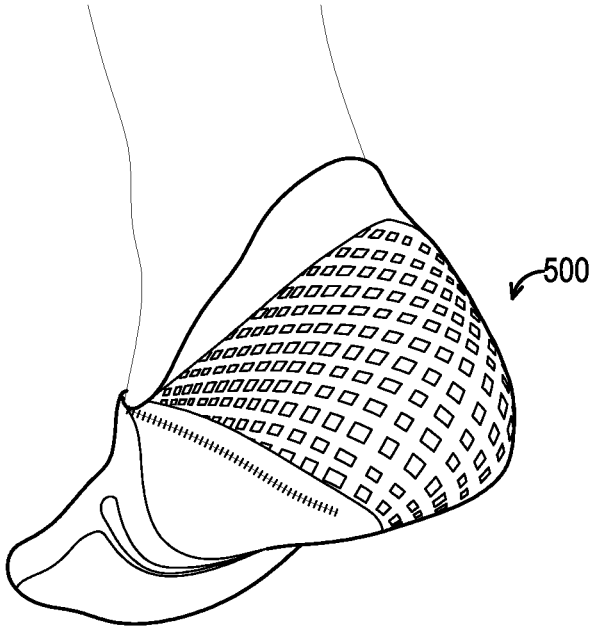
FIG. 19 is an inside view of the heel knit pattern of FIG. 18.
Figure 20:
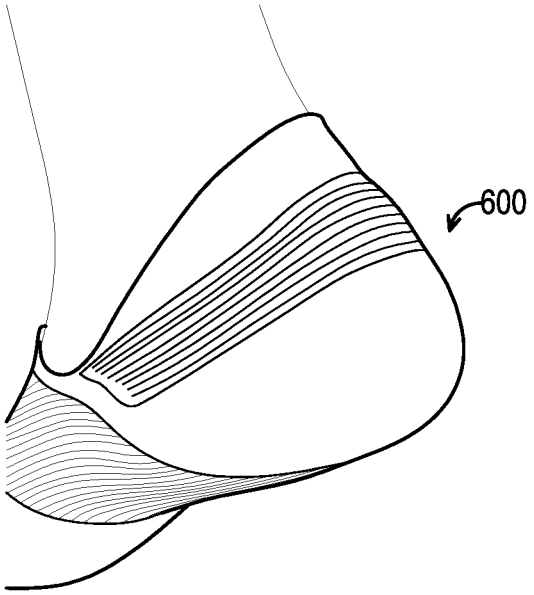
FIG. 20. is an outside view of a second illustrative heel knit pattern for socks described herein.
Figure 21:
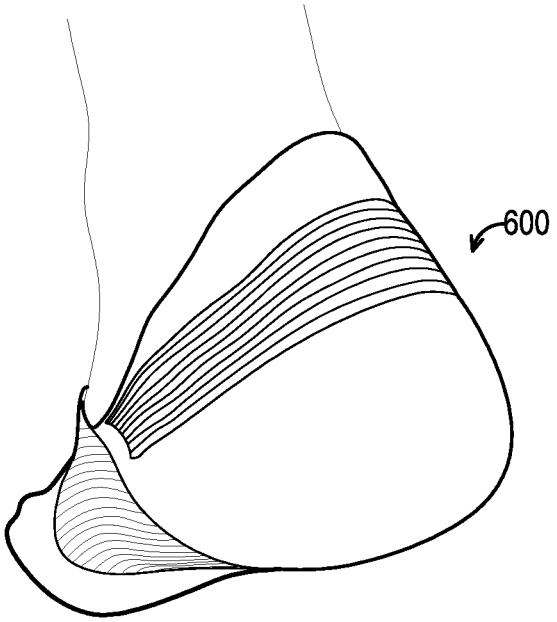
FIG. 21 is an inside view of the heel knit pattern of FIG. 20.

FIGS. 18-21 depict a series of illustrative heel knitting patterns for socks in accordance with aspects of the present disclosure. Heel knitting patterns depicted in FIGS. 18-21 are suitable for use in socks 200, 300, and/or 400. FIGS. 18-19 depict a heel knitting pattern 500 which includes a greater degree of cushioning and which includes terry loops on inside surfaces. FIGS. 20-21 depict a heel knitting pattern 600 which includes terry loops arranged in stripes on outside surfaces, and which can help the heel of the sock conform to a heel of a wearer.

E. Illustrative Method

Figure 22:
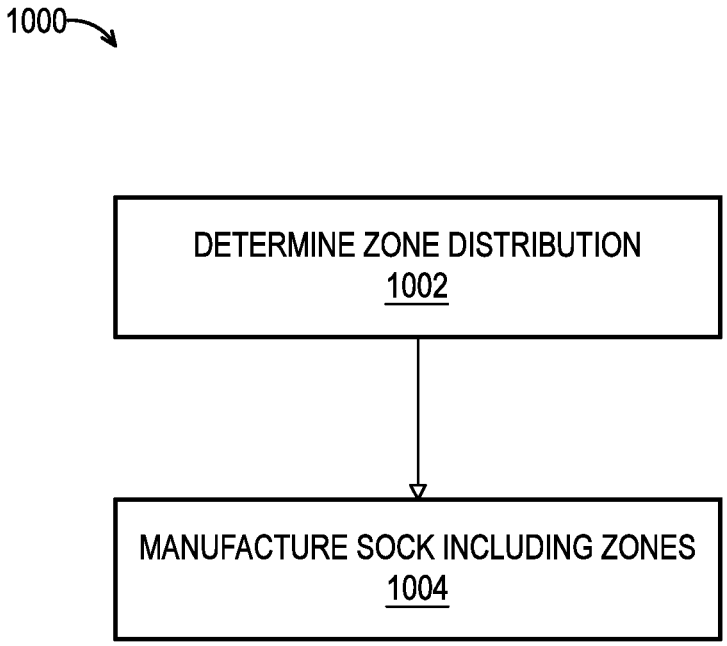
FIG. 22 is a flow chart depicting steps of an illustrative method for manufacturing socks in accordance with aspects of the present disclosure.

This section describes steps of an illustrative method 1000 for manufacturing socks in accordance with aspects of the present disclosure; see FIG. 22. Aspects of computer model 100 and socks 200, 300, and 400 may be utilized in the method steps described below. Where appropriate, reference may be made to components and systems that may be used in carrying out each step. These references are for illustration, and are not intended to limit the possible ways of carrying out any particular step of the method.

FIG. 1000 is a flowchart illustrating steps performed in an illustrative method, and may not recite the complete process or all steps of the method. Although various steps of method 1000 are described below and depicted in FIG. 22, the steps need not necessarily all be performed, and in some cases may be performed simultaneously or in a different order than the order shown.

Step 1002 of method 1002 includes determining a distribution of cushioning, sweat dissipation, and skin sensitivity zones. In some examples, determining a distribution of zones includes performing load mapping of a foot of a test subject performing a desired task (e.g., running, playing tennis, walking, playing basketball, etc.). In some examples, determining a distribution of zones includes mapping sweat production within a foot of a test subject performing a desired task. In some examples, determining a distribution of zones includes mapping zones of skin sensitivity within a foot of a test subject performing a desired task. The above mapping tasks may be performed with the aid of a computer or may be performed manually. In some examples, the above mapping tasks are performed a plurality of times at different points within a test subject's workout (e.g., at different points within a subject's stride, at different fatigue levels, etc.).

Generally, determining a distribution of cushioning, sweat dissipation, and skin sensitivity zones includes averaging, aggregating, and/or otherwise producing a composite distribution. In some examples, producing a composite distribution results in a gradient distribution throughout different zones.

Step 1004 of method 1000 includes manufacturing a sock including cushioning pods disposed in cushioned zones according to the zone distribution, mesh disposed in sweat dissipation zones according to the zone distribution, and ribbed fabric or cushioning pods disposed in sensitive zones according to the zone distribution.

In some examples, manufacturing the sock includes utilizing a machine designed to knit circular (AKA tubular) knit products and fabrics. In some examples, machines utilized to manufacture the sock are fully electronic and have the ability to knit different knit structures on a stitch-by-stitch basis. Knitting the sock using an electronic knitting machine allows for the creation of knit cushioning pods comprising a plurality of terry loops, mesh ventilation areas, and ribbed structures in a single tube of material. In some examples, socks manufactured according to this method may be stitched only at the toe to produce a finished garment. In some examples, manufacturing the sock includes programming the knitting machine to produce the sock.

In some examples, manufacturing the sock includes weaving the sock to produce one or more pieces of woven material, and sewing the pieces of woven material together to produce a sock.

In some examples, manufacturing the sock includes utilizing a flat-bed knitting machine to produce one or more pieces of knitted material, and sewing the pieces of knitted material together to produce a sock.

In some examples, manufacturing the sock includes sewing together one or more pieces of pre-fabricated knitted material.

The following reference numerals may be utilized in the accompanying drawings:

100 illustrative computer model
110 sweat production zones
120 skin sensitivity zones
130, 132 pressure loading zones
200 first illustrative sock
202 first toe portion
204 first heel portion
206 first foot opening
208 first toe seam
210 first heel tab
212 first elastic ribbing
220 first sock body
222 first cushioning zones
224 first mesh zones
226 first ribbing zones
300 second illustrative sock
302 second toe portion
304 second heel portion
306 second foot opening
308 second toe seam
310 second heel tab
312 second elastic ribbing
320 second sock body
322 second cushioning zones
324 second mesh zones
326 second ribbing zones
328 second mesh pods, second mesh windows
329 mesh pod loops
330 second cushioning pods
332 terry loops
334 long terry loops
400 third illustrative sock
402 third toe portion
404 third heel portion
406 third foot opening
408 third toe seam
410 third heel tab
412 third elastic ribbing

420 third sock body
422 third cushioning zones
424 third mesh zones
426 third ribbing zones
430 third cushioning pods
500 first heel knitting pattern
600 second heel knitting pattern
1000 method of manufacture
1002 step
1004 step

F. Illustrative Combinations and Additional Examples

This section describes additional aspects and features of socks having targeted cushioning zones, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A cushioned performance sock comprising:
one or more cushioning zones each including a plurality of raised cushioning pods, the one or more cushioning zones being disposed in areas of the sock configured to relieve pressure loading on an underlying foot;
one or more mesh zones disposed in areas of the sock configured to receive sweat from the foot; and
one or more ribbed zones disposed in areas of the sock configured to interface with sensitive skin areas of the foot;
wherein the cushioned performance sock is formed as a single piece.

A1. The cushioned athletic sock of paragraph A0, wherein a density of the raised cushioning pods is gradated based on an amount of pressure expected to be applied to corresponding areas of the foot.

A2. The cushioned performance sock of paragraph A0 or A1, wherein the raised cushioning pods comprise a plurality of raised terry loops within a knit structure of the cushioned performance sock.

A3. The cushioned performance sock of any one of paragraphs A0 through A2, wherein the mesh zones comprise a plurality of mesh pods including a mesh fabric disposed on an exterior surface of the sock.

A4. The cushioned performance sock of any one of paragraphs A0 through A3, wherein a size of the raised cushioning pods is gradated based on an amount of pressure expected to be applied to corresponding areas of the foot.

B0. A cushioned performance sock comprising:
a plurality of raised cushioning pods disposed within cushioning zones, wherein the raised cushioning pods comprise a plurality of raised terry loops disposed within an interior region of the sock; and
a plurality of mesh zones comprising a mesh fabric;
wherein the sock comprises a single seam disposed at a toe of the sock;
wherein the cushioning zones are disposed in areas of the sock corresponding to weight-bearing areas of a foot of a wearer; and
wherein the mesh zones are disposed in areas of the sock corresponding to areas of the foot of the wearer which produce sweat.

B1. The cushioned performance sock of paragraph B0, further comprising a plurality of ribbed zones comprising a ribbed fabric disposed in areas of the sock corresponding to areas of the foot of the wearer which have sensitive skin.

C0. A cushioned performance sock comprising:
a single piece of knitted material, including:
a plurality of raised cushioning pods disposed within areas of the sock corresponding to the ball of a wearer's foot and the heel of the wearer's foot; and
a plurality of mesh regions comprising mesh fabric disposed within areas of the sock corresponding to the arch of the wearer's foot and the top of the wearer's foot.

D0. A method of manufacturing a cushioned performance sock, the method comprising:
determining a distribution of cushioning, sweat dissipation, and skin sensitivity zones; and
manufacturing a sock, according to the determined distribution of zones, to include cushioning pods disposed in the cushioning zones, mesh disposed in the sweat dissipation zones, and ribbed fabric or cushioning pods disposed in sensitive zones.

D1. The method of paragraph D0, wherein determining a distribution of cushioning, sweat dissipation, and skin sensitivity zones includes averaging, aggregating, or otherwise producing a composite distribution of recorded data.

D2. The method of paragraph D0 or D1, wherein manufacturing the sock includes utilizing a machine designed to knit circular knit products.

E0. A cushioned performance sock, comprising:
a plurality of cushioning regions each including a plurality of raised cushioning pods disposed on an interior surface of the sock, wherein each of the raised cushioning pods comprises a plurality of terry loops; and
a plurality of mesh regions;
wherein the sock comprises a single seam disposed at a toe of the sock.

E1. The sock of E0, wherein the terry loops of each of the cushioning pods are collectively capped by a respective plurality of yarn loops.

E2. The sock of E0 or E1, wherein the cushioning regions correspond to a ball and a heel of a foot when worn.

E3. The sock of any one of paragraphs E0 through E2, wherein the mesh regions correspond to an arch and a top of the foot when worn.

E4. The sock of any one of paragraphs E0 through E3, further comprising a ribbed region.

E5. The sock of E4, wherein the ribbed region is disposed in a toe area of the sock.

E6. The sock of any one of paragraphs E0 through E5, wherein the mesh regions each comprise a plurality of mesh windows disposed on an exterior surface of the sock.

E7. The sock of E6, wherein each of the mesh windows comprises a floating mesh fabric formed within a knit structure of the sock, offset from the interior surface by yarn loops extending a width of the mesh window.

E8. The sock of any one of paragraphs E0 through E8, wherein the plurality of raised cushioning pods in at least one of the cushioning regions have different sizes arranged according to a gradient.

F0. A cushioned performance sock, comprising:

a cushioning region corresponding to a ball of a foot when worn, the cushioning region including a plurality of raised cushioning pods disposed on an interior surface of the sock, wherein each of the raised cushioning pods comprises a plurality of terry loops collectively capped by a plurality of looped strands of yarn;

one or more mesh regions; and one or more ribbed regions;

wherein the sock comprises a single seam disposed at a toe of the sock.

F1. The sock of F0, wherein the cushioning region corresponds to a ball of a foot when worn.

F2. The sock of F0 or F1, wherein the mesh region corresponds to an arch of the foot when worn.

F3. The sock of any one of paragraphs F0 through F2, wherein the ribbed region is disposed in a toe area of the sock.

F4. The sock of any one of paragraphs F0 through F3, wherein the mesh region comprises a plurality of mesh windows disposed on an exterior surface of the sock, wherein each of the mesh windows comprises a floating mesh fabric formed within a knit structure of the sock, offset from the interior surface by yarn loops extending a width of the mesh window.

F5. The sock of any one of paragraphs F0 through F4, wherein the plurality of raised cushioning pods have different sizes arranged according to a gradient.

G0. A cushioned performance sock, comprising:

a cushioning region corresponding to a ball of a foot when worn, the cushioning region including a plurality of raised cushioning pods disposed on an interior surface of the sock, wherein each of the raised cushioning pods comprises a plurality of terry loops collectively capped by a plurality of looped strands of yarn; and one or more ribbed regions;

wherein the sock comprises a single seam disposed at a toe of the sock.

G1. The sock of G0, wherein the cushioning region corresponds to a ball of a foot when worn.

G2. The sock of G0 or G1, wherein the ribbed region corresponds to a toe area.

G3. The sock of any one of paragraphs G0 through G2, further comprising a plurality of mesh windows disposed on a region of an exterior surface of the sock, wherein each of the mesh windows comprises a floating mesh fabric formed within a knit structure of the sock, offset from the interior surface by yarn loops extending a width of the mesh window.

G4. The sock of any one of paragraphs G0 through G3, wherein the plurality of raised cushioning pods have different sizes arranged according to a gradient.

Advantages, Features, and Benefits

The different embodiments and examples of the socks having targeted cushioning zones described herein provide several advantages over known performance socks. For example, illustrative embodiments and examples described herein provide cushioning only within regions of the foot which experience pressure loading, reducing bulk within the sock.

Additionally, and among other benefits, illustrative embodiments and examples described herein provide mesh within areas of the foot which produce sweat, improving sock breathability.

Additionally, and among other benefits, illustrative embodiments and examples described herein provide cushioning within areas of the foot which have sensitive skin.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A cushioned performance sock, comprising:

a plurality of cushioning regions each including a plurality of discrete raised cushioning pods disposed on an interior surface of the cushioned performance sock, wherein each discrete raised cushioning pod of the plurality of discrete raised cushioning pods comprises a plurality of terry loops; and a plurality of mesh regions;

wherein the cushioned performance sock comprises a single seam disposed at a toe of the cushioned performance sock;

wherein at least one cushioning region of the plurality of cushioning regions has at least a first portion and a second portion, the first portion configured to receive a higher degree of pressure loading than the second portion; and wherein a density of the plurality of discrete raised cushioning pods in the at least one cushioning region is gradated such that the first portion of the at least one cushioning region has a higher density of discrete raised cushioning pods than the second portion of the at least one cushioning region, such that a distance between immediately adjacent discrete raised cushioning pods in the first portion of the at least one cushioning region is less than a distance between immediately adjacent discrete raised cushioning pods in the second portion of the at least one cushioning region.

2. The cushioned performance sock of claim 1, wherein the plurality of terry loops of each raised cushioning pod of the plurality of discrete raised cushioning pods is collectively capped by a respective plurality of yarn loops.

3. The cushioned performance sock of claim 1, wherein the plurality of cushioning regions corresponds to a ball and a heel of a foot when worn.

4. The cushioned performance sock of claim 1, wherein the plurality of mesh regions corresponds to an arch and a top of a foot when worn.

5. The cushioned performance sock of claim 1, further comprising a ribbed region.

6. The cushioned performance sock of claim 5, wherein the ribbed region is disposed adjacent a toe area of the cushioned performance sock.

7. The cushioned performance sock of claim 1, wherein each mesh region of the plurality of mesh regions comprises a plurality of mesh windows disposed on an exterior surface of the cushioned performance sock.

8. The cushioned performance sock of claim 7, wherein each mesh window of the plurality of mesh windows comprises a floating mesh fabric formed within a knit structure of the cushioned performance sock, the floating mesh fabric being offset from the interior surface by yarn loops extending a width of each of the mesh window.

9. The cushioned performance sock of claim 1, wherein the plurality of discrete raised cushioning pods in the at least one cushioning region have different sizes arranged according to a gradient.

10. A cushioned performance sock, comprising:

a cushioning region corresponding to a ball of a foot when worn, the cushioning region including a plurality of discrete raised cushioning pods disposed on an interior surface of the cushioned performance sock, wherein each discrete raised cushioning pod of the plurality of discrete raised cushioning pods comprises a plurality of terry loops collectively capped by a plurality of looped strands of yarn, and wherein one or more discrete raised cushioning pods of the plurality of discrete raised cushioning pods are spaced apart from each other by fabric having a thickness less than an average thickness of the plurality of discrete raised cushioning pods;

one or more mesh regions; and one or more ribbed regions;

wherein the cushioned performance sock comprises a single seam disposed at a toe of the cushioned performance sock;

wherein the cushioning region has at least a first portion and a second portion, the first portion configured to receive a higher degree of pressure loading than the second portion; and wherein a density of the plurality of discrete raised cushioning pods in the cushioning region is gradated such that the first portion of the cushioning region has a higher density of discrete raised cushioning pods than the second portion of the cushioning region.

11. The cushioned performance sock of claim 10, wherein the one or more mesh regions correspond to an arch of the foot when worn.

12. The cushioned performance sock of claim 10, wherein the one or more ribbed regions are disposed adjacent a toe area of the cushioned performance sock.

13. The cushioned performance sock of claim 10, wherein each mesh region of the one or more mesh regions comprises a plurality of mesh windows disposed on an exterior surface of the cushioned performance sock, wherein each mesh window of the plurality of mesh windows comprises a floating mesh fabric formed within a knit structure of the cushioned performance sock, the floating mesh fabric being offset from the interior surface by yarn loops extending a width of each mesh window.

14. The cushioned performance sock of claim 10, wherein the plurality of discrete raised cushioning pods have different sizes arranged according to a gradient.

15. A cushioned performance sock, comprising:

a cushioning region corresponding to a ball of a foot when worn, the cushioning region including a plurality of discrete raised cushioning pods disposed on an interior surface of the cushioned performance sock, wherein each discrete raised cushioning pod of the plurality of discrete raised cushioning pods comprises a plurality of terry loops collectively capped by a plurality of looped strands of yarn, and wherein one or more discrete raised cushioning pods of the plurality of discrete raised cushioning pods are spaced apart from each other by fabric having a thickness less than an average thickness of the plurality of discrete raised cushioning pods; and one or more ribbed regions;

wherein the cushioned performance sock comprises a single seam disposed at a toe of the cushioned performance sock;

wherein the cushioning region includes at least a first portion and a second portion, the first portion configured to receive a higher degree of pressure loading than the second portion; and wherein a density of the plurality of discrete raised cushioning pods in the cushioning region is gradated such that the first portion of the cushioning region has a higher density of discrete raised cushioning pods than the second portion of the cushioning region, such that a distance between immediately adjacent discrete raised cushioning pods in the first portion of the cushioning region is less than a distance between immediately adjacent discrete raised cushioning pods in the second portion of the cushioning region.

16. The cushioned performance sock of claim 15, wherein the one or more ribbed regions correspond to a region of the cushioned performance sock adjacent a toe area.

17. The cushioned performance sock of claim 15, further comprising a plurality of mesh windows disposed on a region of an exterior surface of the cushioned performance sock, wherein each mesh window of the plurality of mesh windows comprises a floating mesh fabric formed within a knit structure of the cushioned performance sock, the floating mesh fabric being offset from the interior surface by yarn loops extending a width of each mesh window.

18. The cushioned performance sock of claim 15, wherein the plurality of discrete raised cushioning pods have different sizes arranged according to a gradient.

* * * * *